US005447140A

United States Patent [19]

Brisbane et al.

[11] Patent Number: 5,447,140

[45] Date of Patent: Sep. 5, 1995

[54] FUEL INJECTION

[75] Inventors: Roger M. Brisbane, Spencerport; Edwin A. Rivera, Fairport; Daniel L. Varble, Henrietta; David R. Schumann, Rochester, all of N.Y.

[73] Assignee: General Motors Corporation, Detroit, Mich.

[21] Appl. No.: 169,240

[22] Filed: Dec. 20, 1993

[51] Int. Cl.[6] ..... F02M 51/00

[52] U.S. Cl. ..... 123/456; 123/472

[58] Field of Search ..... 123/52 M, 52 MC, 52 MV, 123/456, 468, 469, 470, 472

[56] References Cited

U.S. PATENT DOCUMENTS

| | | | |
|---|---|---|---|
| 4,149,496 | 4/1979 | Palma | 123/470 |
| 4,210,117 | 7/1980 | Brinkman | 123/504 |
| 4,341,193 | 7/1982 | Bowler | 123/472 |
| 4,347,822 | 9/1982 | Casey | 123/470 |
| 4,347,823 | 9/1982 | Kessler et al. | 123/472 |
| 4,510,909 | 4/1985 | Elphick et al. | 123/470 |
| 4,586,477 | 5/1986 | Field et al. | 123/468 |
| 4,753,205 | 6/1988 | Knapp et al. | 123/472 |
| 4,955,347 | 9/1990 | Toyoda | 123/470 |
| 5,069,186 | 12/1991 | Illien | 123/456 |
| 5,070,845 | 12/1991 | Avdenko et al. | 123/470 |
| 5,082,184 | 1/1992 | Stettner et al. | 239/408 |
| 5,086,743 | 2/1992 | Hickey | 123/456 |
| 5,111,794 | 5/1992 | Degrace, Jr. | 123/456 |
| 5,172,671 | 12/1992 | Peters et al. | 123/456 |
| 5,178,114 | 1/1993 | McArthur | 123/456 |
| 5,178,115 | 1/1993 | Daly | 123/456 |
| 5,226,391 | 7/1993 | Gras et al. | 123/456 |

FOREIGN PATENT DOCUMENTS

| | | |
|---|---|---|
| 2734858 | 3/1978 | Germany . |
| 0536091 | 9/1992 | Italy . |
| 2215776 | 9/1989 | United Kingdom . |
| 84/04567 | 5/1984 | WIPO . |

*Primary Examiner*—Thomas N. Moulis
*Attorney, Agent, or Firm*—Karl F. Barr, Jr.

[57] ABSTRACT

A fuel system for use on an internal combustion engine has a fuel metering body which defines a fuel plenum therein. The plenum has an inlet for pressurized fuel, a pressure regulator, and a fuel outlet. Disposed within the fuel plenum, in fluid communication with one another, the inlet and the outlet, are a plurality of fuel injectors. The fuel injectors have outlets which extend through the fuel meter body and deliver fuel to the intake ports of the associated engine through flexible fuel lines terminated by pressure pulse activated poppet nozzles providing a significant degree of application flexibility. The fuel meter body mounts within the intake manifold such that fuel and electrical connections extend out of the manifold for simplified source attachment.

3 Claims, 3 Drawing Sheets

FUEL INJECTION

TECHNICAL FIELD

This invention relates to a fuel injection system for a multi-cylinder internal combustion engine in which a plurality of injection nozzles discharge fuel adjacent the engine inlet ports and individual injectors operating from a single fuel plenum meter fuel to the nozzles.

BACKGROUND

In the fuel injection systems set forth in U.S. Pat. No. 5,070,845 issued Dec. 10, 1991 in the name of Advenko et al. and in U.S. Pat. No. 5,082,184 issued Jan. 21, 1992 in the name of Stettner et al., a single injector meters fuel which is distributed to a plurality of fuel lines having nozzle terminations. The nozzles discharge fuel adjacent the engine intake ports. Such a system has, as a principle feature or benefit, the localization of fuel metering components in a single fuel metering body which can be located inside of the intake manifold. The use of a single injector dictates that each nozzle and, as a result, each cylinder be fueled simultaneously, without regard to cylinder timing. The result is less than optimal engine and emission performance. In addition, the location of the fuel meter body within the intake manifold proliferates the connective hardware required for fuel and electric to pass through the wall of the manifold.

In the fuel injection systems set forth in U.S. Pat. No. 4,510,909 issued Apr. 16, 1985 in the name of Elphick et al. and in U.S. Pat. No. 4,586,477 issued May 6, 1986 in the name of Field et al., fuel rails deliver fuel to a plurality of outwardly extending electromagnetic fuel injectors. The rail-injector assembly is secured to the exterior of the intake manifold of an engine with the injectors received in openings therein for delivery of fuel to associated engine cylinders. The use of individual injectors for each cylinder permits optimization of the fueling event. The location of the fuel rail and its relatively large surface area may cause fuel passing through the rail to be subjected to significant heating, increasing the likelihood of hot fuel handling problems and running loss emissions. Fuel rails are application specific, and a separate rail must be designed for each engine. In addition, the electromagnetic injectors used in such systems have relatively large diameters resulting from the placement of the solenoid in the point-of-delivery device. As such, significant limitations are placed on injector location and fuel targeting.

SUMMARY OF THE INVENTION

The present invention is directed to a fuel injection system having a fuel meter body which functions as the system chassis for the mounting of primary fuel system components. The fuel meter body houses a plurality of individual electromagnetic fuel injectors in a common fuel plenum such that pressure variabilities between the injectors are minimized. The fuel meter body may be configured for assembly within a multi-piece engine intake manifold constructed with an opening for cooperative, sealing engagement with a portion of the fuel meter body such that fuel and electrical connections to the fuel system remain external to the intake air plenum.

In a preferred embodiment, the fuel meter body is configured such that both ends of each of the electromagnetic fuel injectors extend out of the fuel plenum to facilitate the attachment of fuel delivery tubes to the injector outlets and electrical connectors to the solenoid ends. Each injector is associated with a flexible fuel line and a poppet nozzle which facilitates delivery of fuel to intake locations corresponding to each engine cylinder. Location of the metering portion of the fuel system, remote from the fuel nozzle, supports a smaller terminal unit therefore enhancing the positioning of the nozzle and targeting of fuel while allowing individual engine cylinder fueling.

The present invention discloses a fuel system having a compact fuel metering body which delivers fuel sequentially to a plurality of engine cylinders through flexible tubes supplied by individual electromagnetic fuel injectors and terminated by pressure activated poppet nozzles.

The fuel plenum disclosed, establishes a uniform fuel path from the fuel supply to the injectors and from the injectors to the fuel return so as to provide uniform fuel delivery to each injector throughout the engine operating range.

The fuel system of the present invention provides for centralized and flexible location of a fuel system with sequential fuel delivery across a wide range of engine configurations without the necessity for redesign of key fuel system components.

The fuel system of the present invention has the advantage of sequential fuel delivery with reduced mass, surface area and fuel volume thereby significantly lowering the transfer of heat, generated in the engine compartment, to the fuel system. The fuel metering body can be integrally located within the relatively cool environment of the intake manifold, rather than on the exterior of the manifold, providing additional benefits relative to fuel system heating.

These and other features, objects and advantages of the invention will be more apparent by reference to the following claims and to the drawings.

DESCRIPTION OF THE PREFERRED EMBODIMENT

Figure 1:
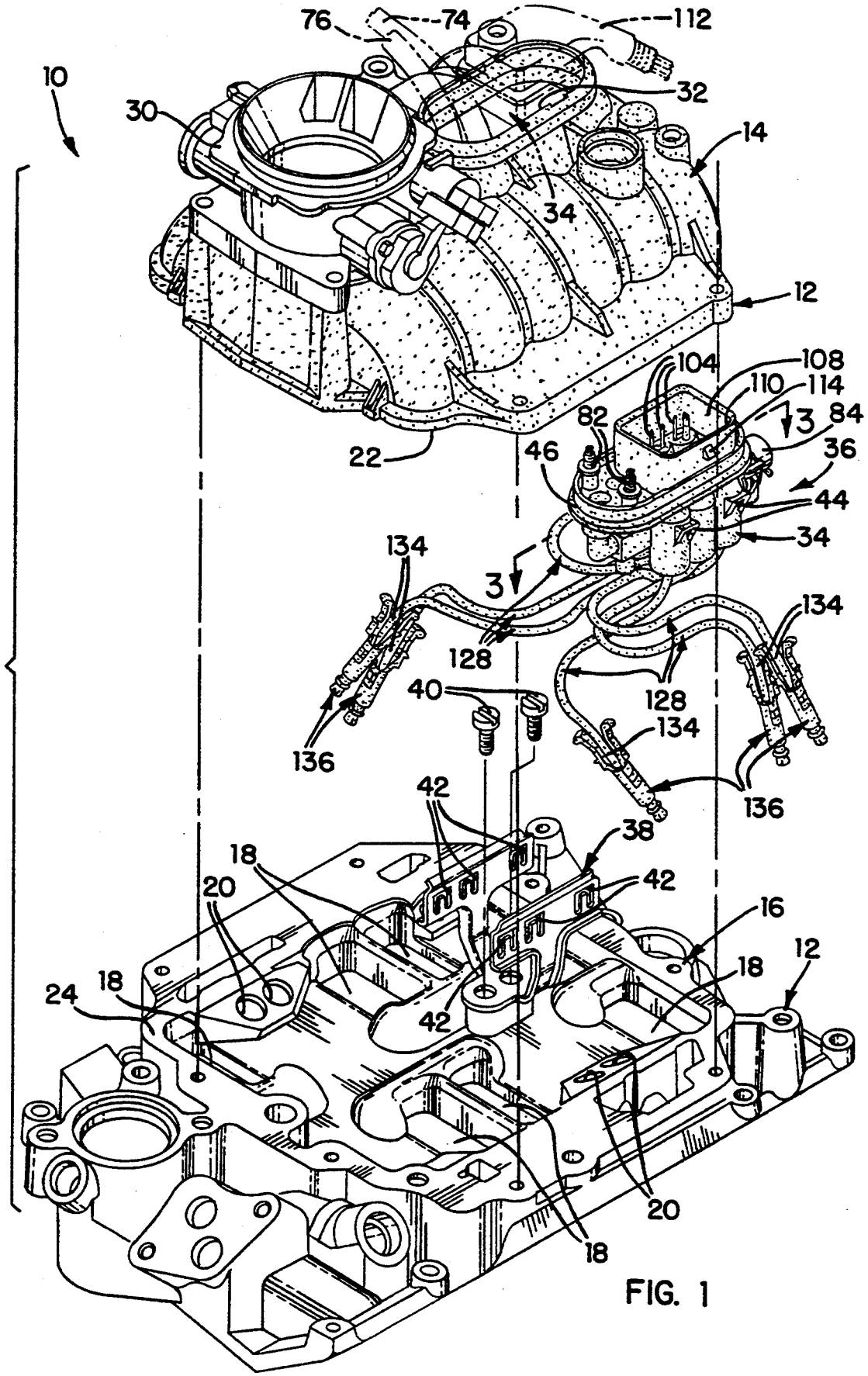
FIG. 1 is a disassembled view of an integrated fuel and air induction system for an internal combustion engine, embodying features of the present invention.

FIG. 1 shows an integrated fuel and air induction system, designated generally as 10, for supply of metered air and fuel to the intake ports of an internal combustion engine (not shown). The integrated fuel and air induction system includes a two piece intake manifold 12 having upper and lower manifold members 14 and 16, respectively. The lower intake manifold member 16 is configured for assembly to the piston deck of an internal combustion engine block with the manifold shown in FIG. 1 of the type for application to a v-configured engine. Air passages such as intake runners 18 in lower member 16 transfer intake air from the intake manifold 12 to the intake ports of the engine while fuel nozzle openings 20 accommodate fuel nozzles, to be described in further detail below, for delivering metered pulses of fuel into the intake runners 18.

Figure 2:
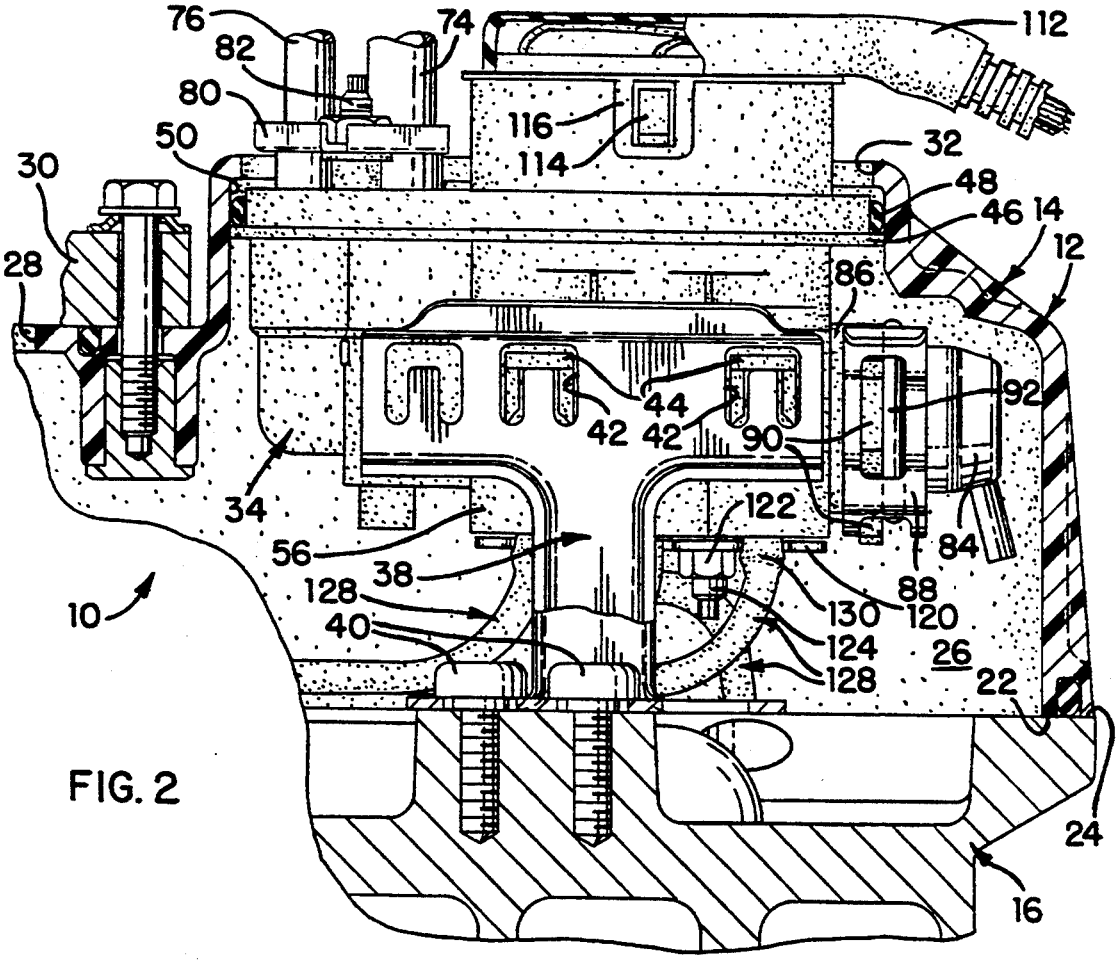
FIG. 2 is a partial sectional view of the integrated fuel and air induction system of FIG. 1 with parts assembled.

The upper intake manifold member 14 is configured for sealing engagement with the lower member 16 along mating surfaces 22 and 24 to define an intake air plenum 26, see FIG. 2, therebetween. A first opening 28 in the upper member 14 is configured to receive intake air through a throttle body assembly 30 while a second opening 32 receives a portion of a fuel meter body 34 of a fuel injection system 36, disposed within the assembled air intake manifold 12.

Referring now to FIG. 2, fuel meter body 34 may be assembled into the intake manifold 12 as an integral component. Attachment means such as support bracket 38 is assembled to the lower member 16 using screws 40 or other suitable means for attachment. Slots 42 in the support bracket 38 are engaged by corresponding attachment pegs 44, depending from the exterior of the fuel meter body 34, to support the fuel meter body in a fixed position within the manifold 12. A flanged sealing platform 46 depends from an upper portion of the fuel meter body 34. A resilient sealing member such as O-ring 48 disposed about the platform engages a corresponding surface 50, extending about opening 32 in upper member 14, with a leak-free seal to close the opening and establish the fuel meter body 34 integrally with the upper intake manifold member 14.

Figure 3:
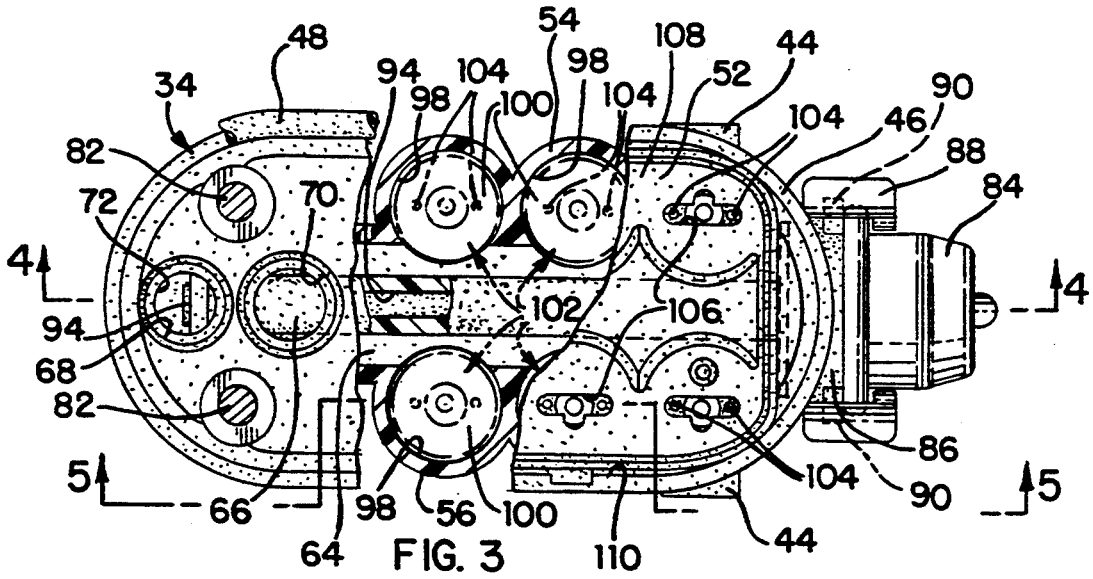
FIG. 3 is a partial sectional view of the fuel distributor of the present invention taken along line 3—3 of FIG. 1.
Figure 4:
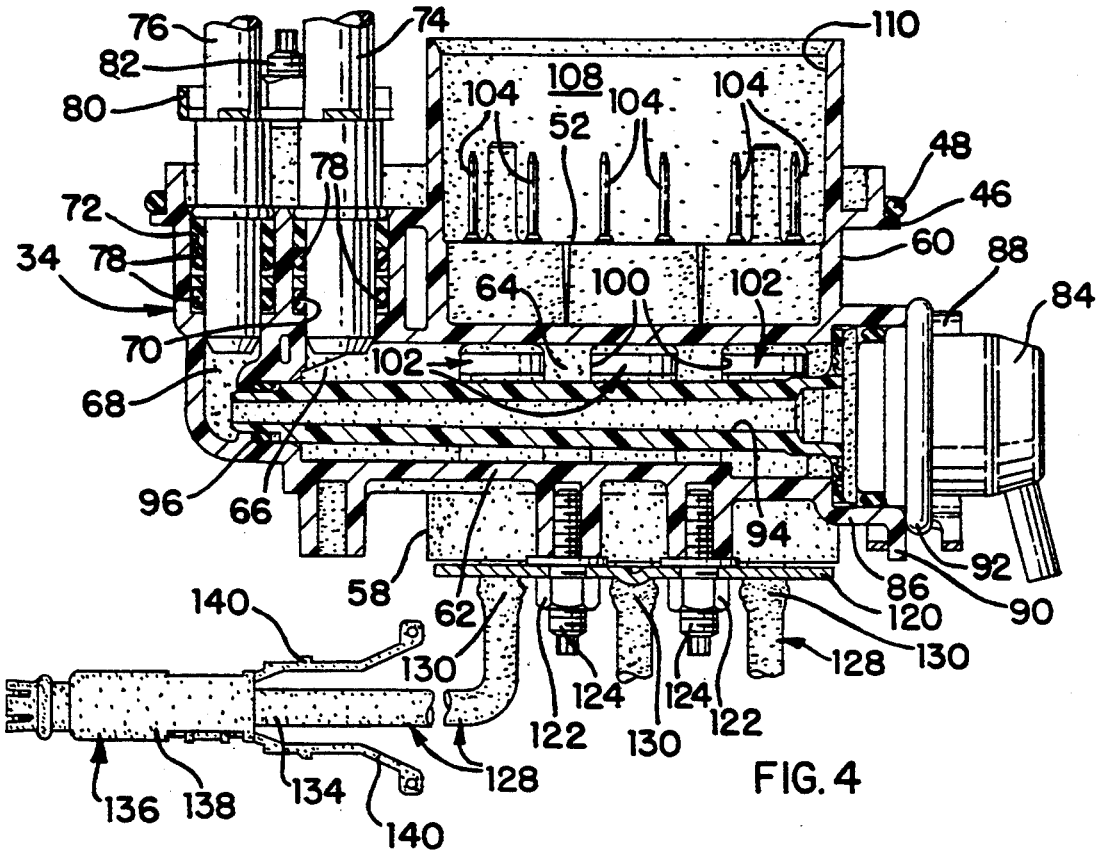
FIG. 4 is a side sectional view of the fuel distributor of FIG. 3 taken along line 4—4 of FIG. 3.
Figure 5:
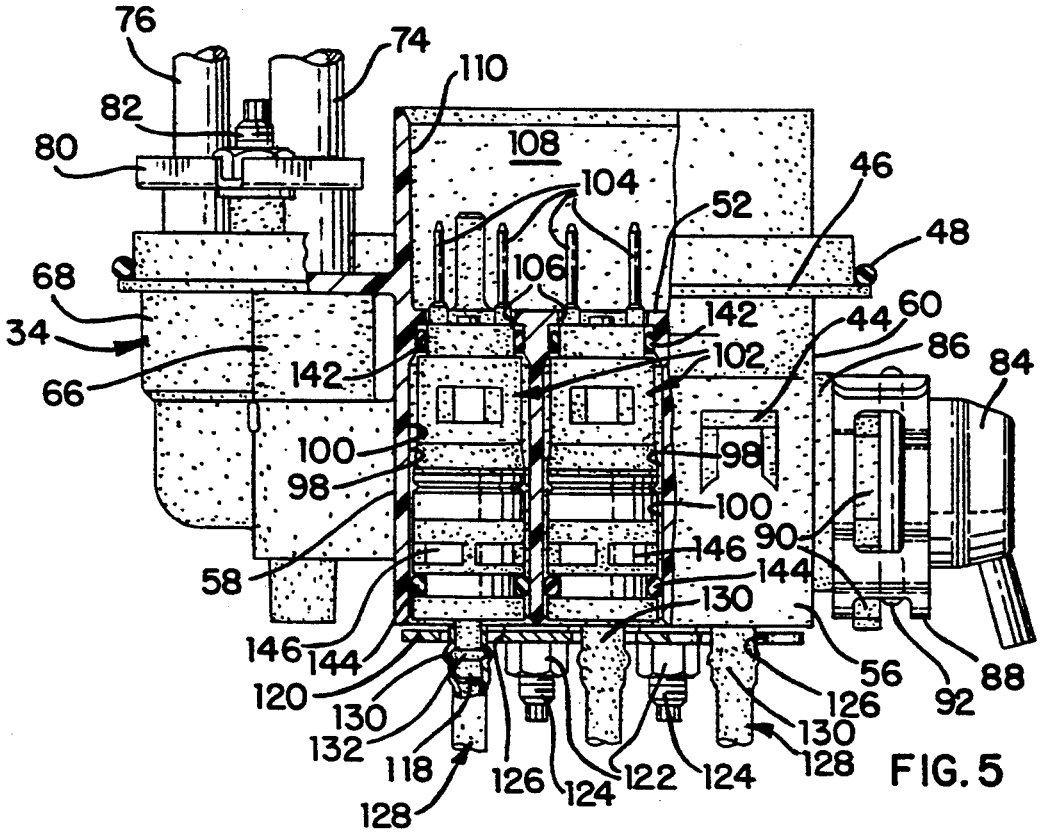
FIG. 5 is a side view partially in section of the fuel distributor of FIG. 3 taken along line 5—5 of FIG. 3.

Referring now to FIGS. 3, 4 and 5, the fuel meter body 34 of the integrated air and fuel induction system 10 functions as a chassis for the fuel system, to which substantially all fuel system components are mounted. The fuel meter body may be constructed of any suitable material for such an environment, such as glass filled nylon. The fuel meter body has a top 52, sides 54,56,58,60, and a bottom 62 which together define an internal fuel plenum 64 within the body. Associated with a side of the plenum 64 are a pressurized fuel inlet 66 and a fuel outlet 68. Both the inlet and the outlet have terminal ends which extend through the flanged sealing platform 46 such that fuel system supply and return connections, necessary to supply fuel to the plenum 64 can be made externally of the intake manifold 12. The terminal ends of inlet and outlet 66,68 have walls 70,72 extending into fuel meter body 34 for accepting terminal end portions of supply and return connections 74,76. Resilient sealing members such as O-rings 78 are disposed between the connections 74,76 and walls 70,72 to prevent leakage of fuel. The connections are secured in place using a clamping member 80 mounted on studs 82.

An opening in side 60 of fuel plenum 64 accommodates fuel pressure regulator 84. An annular wall 86 defines a seat for pressure regulator 84. A spring retainer 88, engages pegs 90, which depend from the wall 86, and an annular collar 92 on regulator 84, to fix the regulator in position. The regulator 84 operates in a conventional manner known in the art, allowing fuel pressure in fuel plenum 64 to rise to a desired level at which time fuel is permitted to pass through the regulator 84 and into a tubular passage 94 extending from the regulator, through fuel plenum 64 to terminate at the base of fuel outlet passage 68. A resilient sealing member such as O-ring 96 prevents fuel from passing between the tubular passage 94 and the fuel plenum 64. The location of the fuel pressure regulator 84 relative to the fuel inlet 66 establishes end-to-end fuel flow through the fuel plenum 64.

The bottom 62 of plenum 64 includes a plurality of cylindrical openings 98 which extend into the plenum and have walls which define cylindrical chambers 100 extending from the bottom to the top 52 of the plenum. The chambers 100 are each opened, FIGS. 3 and 4, to the plenum 64 to thereby place each of the cylindrical chambers in fluid communication with the others. The cylindrical chambers 100 each slidingly receive an electromagnetic fuel injector 102 therein. The injectors 102 extend from the top to the bottom of the chambers 100 with electrical connectors 104 at the first or upper ends thereof, extending through corresponding openings 106 in the top 52 of the fuel plenum 64.

The openings 106 through which the electrical connectors 104 pass, open into a pocket 108 defined by wall 110 which depends from flanged sealing platform 46. The walled pocket 108 permits the attachment of an electrical connector 112, externally of the intake manifold 12. Attachment studs 114 depending from the exterior of the wall 110 engage corresponding tabs 116 extending from the connector 112 to secure the connector against displacement. The connector 112 operates to seal the electrical connections 104 against moisture and other contamination.

The second, or outlet end 118 of each fuel injector 102 projects outwardly from the cylindrical openings 98 in the bottom 62 of the fuel plenum 64, FIG. 5. To secure against extrusion of the injectors 102 from the fuel meter body 34 under the pressure of fuel in the plenum 64, a retaining plate 120 attaches to the bottom of the fuel meter body and is secured by bolts 122 attached to studs 124. The retaining plate 120 has openings 126, providing clearance for the outlet ends 118 of the injectors 102 and facilitate the attachment of fuel delivery lines 128 thereto.

The fuel delivery lines 128, in the preferred embodiment disclosed presently, are fabricated from a suitable, fuel resistant flexible material such as nylon. Lines 128 are attached at a first end 130 to the outlet end 118 of the injectors 102. An annular ridge 132 on the outer surface of the injector outlet end 118 is operable to prevent disengagement of the fuel line therefrom. The second end 134 of each fuel line 128 is terminated by a pressure pulse activated poppet nozzle 136. The nozzle 136 is carried in a mounting sleeve 138 having integral attaching means such as clips 140. The sleeve and nozzle are removably insertable into the fuel nozzle openings 20 in the lower member 16 of intake manifold 12 for delivery of fuel to the intake runners 18.

The flexible fuel lines 128 that deliver fuel from the fuel meter body 34 to the poppet nozzles 136 maximize the applicability of the fuel system to various engine platforms with a minimization of redesign and part proliferation. As an example, the disclosed system can operate in a 90 degree V-6 engine or a 60 degree V-6 engine with no change to the system. The flexibility of the fuel meter body installation and locateability of the flexible fuel delivery lines render the disclosed fuel system less sensitive to differences in cylinder spacing. In addition, fuel targeting is improved by removal of the fuel metering task, which involves a relatively large solenoid and valve assembly, from the point of fuel delivery in the air plenum, to a centralized fuel plenum. The small size of the poppet nozzle 136 allows enhanced targeting of fuel at the engine intake to be optimized.

Resilient sealing members such as O-rings 142,144 are disposed at the first and second ends of the injectors 102, between the injector and the walls of cylindrical chambers 100, to establish a leak-free seal between the fuel plenum 64 and the openings in the top 52 and bottom 62.

The fuel injectors 102 have fuel inlets 146 located intermediate of the ends thereof for fluid communication with the fuel plenum 64 of the fuel meter body 34. Fuel enters each injector through its respective inlet 146 and is metered through outlet 118 by valve means (not shown) which are actuated in response to an electrical signal from a controller which monitors engine operating conditions. Pulses of pressurized fuel are transmitted through fuel lines 128 to activate the poppet nozzles 136 such that a metered quantity of fuel is injected into the intake air flow at an optimized time and rate.

The distance from the pressure regulator 84 to the injectors 102 is important in that when an injector opens for an injection event, the fuel pressure in the fuel vessel, in this case the plenum 64, will decrease until the pressure wave induced by the event can move through the fluid to the regulator. Once the wave of reduced pressure reaches the regulator 84 it can respond to the drop in pressure by reducing the fuel bypassed to the fuel outlet 68. The concentration of the fuel injectors 102 in a small volume fuel plenum 64 in which the inlets 146 of each injector are in fluid communication with each other, the pressurized fuel inlet 66 and the fuel outlet 68, maximizes the fueling consistency from injector to injector across the operating range. The close proximity of the fuel injectors 102 to the fuel pressure regulator 84 provides for rapid and uniform regulator to injector interaction.

The present invention discloses a fuel system for an internal combustion engine having a compact fuel metering body which, when mounted within the intake plenum of the intake manifold, operates as an integral part of the manifold thereby facilitating the supply of fuel and electrical signals to the injectors disposed therein. The fuel injector body includes a fuel plenum in which a plurality of fuel injectors are disposed in fluid communication with one another, the inlet, and the outlet. Such a configuration reduces fuel pressure variability from injector to injector to maximize fueling consistency. Additionally the compact fuel metering body minimizes the residual heat transferred to the fuel system due to its small volume, reduced surface area, and location within the relatively cool environment of the intake manifold. Maximum compatibility with a wide range of engine configurations is provided through the use of fuel lines extending from the injector outlets to the intake runners which, when constructed of a flexible material, are insensitive to the specific point of fuel delivery.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiment may be modified in light of the above teachings. The embodiment described was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

The embodiments of the invention in which an exclusive property or privilege is claimed are defined as follows:

1. A fuel injection system for an internal combustion engine comprising a fuel meter body having a top, a bottom, and sides defining a fuel plenum therein, said fuel plenum having a pressurized fuel inlet, a fuel pressure regulating means and a fuel outlet associated with said regulating means to maintain fuel in said plenum at a desired pressure, said bottom having a plurality of openings which extend into said plenum and are configured to receive fuel injectors therein, said injectors having fuel inlets in communication with said plenum for receiving fuel therefrom, outlets extending through said openings in said bottom, and electrical connectors extending out of said plenum for connection to energizing means, said injector outlets in operable connection with engine intake ports through fuel lines operable to deliver pulses of pressurized fuel thereto.

2. A fuel injection system for an internal combustion engine comprising a fuel meter body having a top, sides and a bottom defining a fuel plenum therebetween, said fuel plenum having a pressurized fuel inlet associated with one of said sides, a fuel regulating means associated with a second of said sides, said second side located opposite of said first side, and a fuel outlet associated with said pressure regulating means to maintain fuel pressure in said plenum, said fuel inlet and regulating means situated, relative to one another, to establish fuel flow through said plenum, said bottom having a plurality of cylindrical openings extending into said plenum, said openings having walls, defining cylindrical chambers, configured to each receive a fuel injector therein for support within said plenum, said top having a plurality of openings therein, corresponding in number and location to said plurality of cylindrical chambers, each of said top openings configured to receive an electrical terminal portion of an injector received in a corresponding cylindrical chamber, fuel sealing means, associated with said cylindrical openings in said bottom and said openings in said top, said injectors having fuel inlets in communication with said fuel plenum for receiving fuel therefrom and outlets extending through said cylindrical openings in said bottom, said fuel injection system further comprising a plurality of fuel lines each having a first end connected to one of said outlets of said plurality of fuel injectors and terminated at a second end by pressure pulse activated nozzles, said fuel lines and nozzles facilitating fuel delivery from each of said fuel injectors in said fuel plenum of said fuel metering body to a plurality of locations in the intake system of an associated engine.

3. A fuel injection system for an internal combustion engine comprising a fuel metering body having a top, sides and a bottom defining a fuel plenum therebetween, said fuel plenum having a pressurized fuel inlet and a fuel regulating means associated with a fuel outlet to maintain fuel pressure in said plenum, a plurality of cylindrical openings extending through said bottom to open into said plenum and a plurality of openings located in said top of said plenum in coaxial relationship to each of said cylindrical openings in said bottom, wherein each of said cylindrical openings is in fluid communication with said other cylindrical openings in said plenum and is configured to receive a fuel injector therein for support within said plenum such that said injectors are each in fluid communication with said other injectors, each of said injectors comprising an injector body having a first end and a second end, said first end having electrical connection means extending out of said plurality of openings in said top of sid plenum for attachment to energizing means and said second end having an outlet extending outwardly of said plurality of cylindrical openings in said bottom of said plenum, said injectors further comprising fuel inlets, between said first and said second ends, in communication with said fuel plenum for receiving fuel therefrom, said fuel injection system further comprising a plurality of fuel lines each having a first end connected to one of said fuel injector outlets and terminated at a second end by a pressure pulse activated nozzle, said fuel lines and nozzles facilitating fuel delivery from each of said fuel injectors in said fuel plenum of said fuel metering body to a plurality of locations in the intake system of an associated engine.

* * * * *